US008074788B2

(12) United States Patent
Tachibana

(10) Patent No.: US 8,074,788 B2
(45) Date of Patent: Dec. 13, 2011

(54) TRACKING APPARATUS

(75) Inventor: Minoru Tachibana, Tokyo (JP)

(73) Assignee: Toshiba Mitsubishi-Electric Industrial Systems Corporation, Tokyo (JP)

( * ) Notice: Subject to any disclaimer, the term of this patent is extended or adjusted under 35 U.S.C. 154(b) by 49 days.

(21) Appl. No.: 12/663,535

(22) PCT Filed: Jul. 2, 2007

(86) PCT No.: PCT/JP2007/063218

§ 371 (c)(1),
(2), (4) Date: Dec. 8, 2009

(87) PCT Pub. No.: WO2009/004703

PCT Pub. Date: Jan. 8, 2009

(65) Prior Publication Data

US 2010/0181167 A1 Jul. 22, 2010

(51) Int. Cl.
*B65G 13/06* (2006.01)

(52) U.S. Cl. ..... 198/781.05

(58) Field of Classification Search . 198/781.05–781.11
See application file for complete search history.

(56) References Cited

U.S. PATENT DOCUMENTS

| | | | | |
|---|---|---|---|---|
| 4,609,098 | A * | 9/1986 | Morgan et al. | 198/781.06 |
| 5,285,887 | A * | 2/1994 | Hall | 198/460.1 |
| 5,318,167 | A * | 6/1994 | Bronson et al. | 198/577 |
| 5,862,907 | A * | 1/1999 | Taylor | 198/781.05 |
| 6,729,463 | B2 * | 5/2004 | Pfeiffer | 198/460.1 |
| 6,843,362 | B2 * | 1/2005 | Tachibana et al. | 198/460.1 |
| 6,883,660 | B2 * | 4/2005 | Bigelow et al. | 198/781.06 |
| 2003/0116408 | A1 * | 6/2003 | Topmiller et al. | 198/781.05 |
| 2004/0182684 | A1 * | 9/2004 | Guidetti et al. | 198/781.06 |
| 2006/0272929 | A1 * | 12/2006 | Taylor | 198/781.06 |
| 2007/0119690 | A1 * | 5/2007 | Lupton | 198/781.06 |
| 2008/0164125 | A1 * | 7/2008 | Pelak et al. | 198/781.06 |
| 2008/0223302 | A1 * | 9/2008 | Wang et al. | 119/173 |

FOREIGN PATENT DOCUMENTS

| | | | |
|---|---|---|---|
| JP | 63-41309 | A | 2/1988 |
| JP | 63-192509 | A | 8/1988 |
| JP | 11-278643 | A | 10/1999 |
| JP | 2005-15188 | A | 1/2005 |

* cited by examiner

*Primary Examiner* — Mark A Deuble
(74) *Attorney, Agent, or Firm* — Leydig, Voit & Mayer, Ltd.

(57) ABSTRACT

A tracking apparatus which can ensure good-accuracy coincidence between a conveyed material and a tracked position thereof, even when slip occurs in the conveyed material moving across conveyance tables. A sensor is located at a boundary position of a conveyance table, of conveyance tables arranged adjacent to each other, to detect the presence or absence of a conveyed material. Head and tail end tracking data of the conveyed material is generated, and positions of head and tail ends are calculated using conveyance speed of a selected conveyance table as a speed standard. Then, occurrence or nonoccurrence of slip of the conveyed material is determined from the detection signal of the sensor and the positions of head and tail ends. When slip has occurred, head and tail end tracking data generation is stopped. Head and tail end tracking data generation is restarted considering a time delay due to removal of chattering from the detection signal.

1 Claim, 4 Drawing Sheets

TRACKING APPARATUS

TECHNICAL FIELD

The present invention relates to a tracking apparatus which accurately tracks positions of a conveyed material moving across a plurality of conveyance tables.

BACKGROUND ART

In conventional tracking apparatus used in material conveyance and the like of rolling equipment, tracking was caused to be generated in head and tail end positions of a conveyed material, the moving distance of the conveyed material was calculated on the basis of roll rotation (conveyance table speed) signals of a conveyance table, and the head and tail end positions were tracked (refer to Patent Document 1, for example). In the tracking apparatus described in Patent Document 1, tracking corrections were performed by calculating the amount of a slip between the conveyance table and the conveyed material on the basis of the acceleration and deceleration rate of the conveyance table.

Patent Document 1: Japanese Patent Laid-Open No. 2005-15188

DISCLOSURE OF THE INVENTION

Problems to be Solved by the Invention

In the tracking apparatus described in Patent Document 1, the acceleration and deceleration of the conveyance table which provides a calculation basis of the slip amount is calculated on the basis of pulse signals responsive to the roll rotation of the conveyance table. However, with such a correction method, it is difficult to hold tracking errors within a prescribed range all over the conveyance process, and this posed the problem that the tracking accuracy decreases greatly if the above-described errors are accumulated. In particular, when it is necessary to convey conveyed materials over a long distance as in rolling equipment which uses a plurality of conveyance tables, a conveyed material which is actually moving on a preceding conveyance table is recognized as if this conveyed material had been moved to the next conveyance table, thereby posing a problem.

The present invention has been made to solve problems as described above, and the object of the invention is to provide a tracking apparatus which can ensure good-accuracy coincidence between a conveyed material and a tracking position thereof even when a slip occurs in the conveyed material moving across a plurality of conveyance tables.

Means for Solving the Problems

A tracking apparatus of the present invention is a tracking apparatus that comprises a plurality of conveyance tables which convey a conveyed material to a target position, a sensor which is provided in the vicinity of any boundary position of the conveyance tables arranged adjacent to each other and detects the presence or absence of the conveyed material, tracking generation means which causes head and tail end tracking of the conveyed material to be generated and calculates positions of head and tail end tracking by using a conveyance speed of a prescribed one of the conveyance tables as a speed standard, speed standard setting means which sets changing of the speed standard to a conveyance speed of any one of the conveyance tables on the basis of the positions of head and tail end tracking, a chattering removal means which removes chattering from a detection signal of the sensor, time delay correction means which corrects a time delay of head and tail end tracking occurring due to an action of the chattering removal means, slip judgment means which judges occurrence or nonoccurrence of a slip of the conveyed material on the basis of the detection signal of the sensor and the positions of head and tail end tracking, and correction means which causes head and tail end tracking to be stopped by using a detection position of a prescribed one of the sensors as a standard in a case where the occurrence of a slip has been judged by the slip judgment means, and causes head and tail end tracking to be restarted so as to eliminate a position shift due to the slip on the basis of a detection signal of the prescribed one of the sensors and the nature of a correction by the time delay correction means after the stop of head and tail end tracking.

EFFECT OF THE INVENTION

According to the present invention, it is possible to ensure good-accuracy coincidence between a conveyed material and a tracking position thereof even when a slip occurs in the conveyed material moving across a plurality of conveyance tables.

BRIEF OF DESCRIPTION OF THE DRAWINGS

DESCRIPTION OF SYMBOLS

1 conveyed material,
2 conveyance table,
3 conveyance table,
4 conveyance table,
5 conveyance table,
6 roller,
7 sensor,
8 sensor,
9 sensor,
10 tracking generation means,
11 speed standard setting means,
12 chattering removal means,
13 time delay correction means,
14 slip judgment means,
15 correction means,
16 tracking,
17 on-delay timer,

18 off-delay timer

BEST MODE FOR CARRYING OUT THE INVENTION

The present invention will be described in more detail with reference to the accompanying drawings. Incidentally, in each of the drawings, like numerals refer to like or similar parts and overlaps of description of these parts are appropriately simplified or omitted.

First Embodiment

Figure 1:
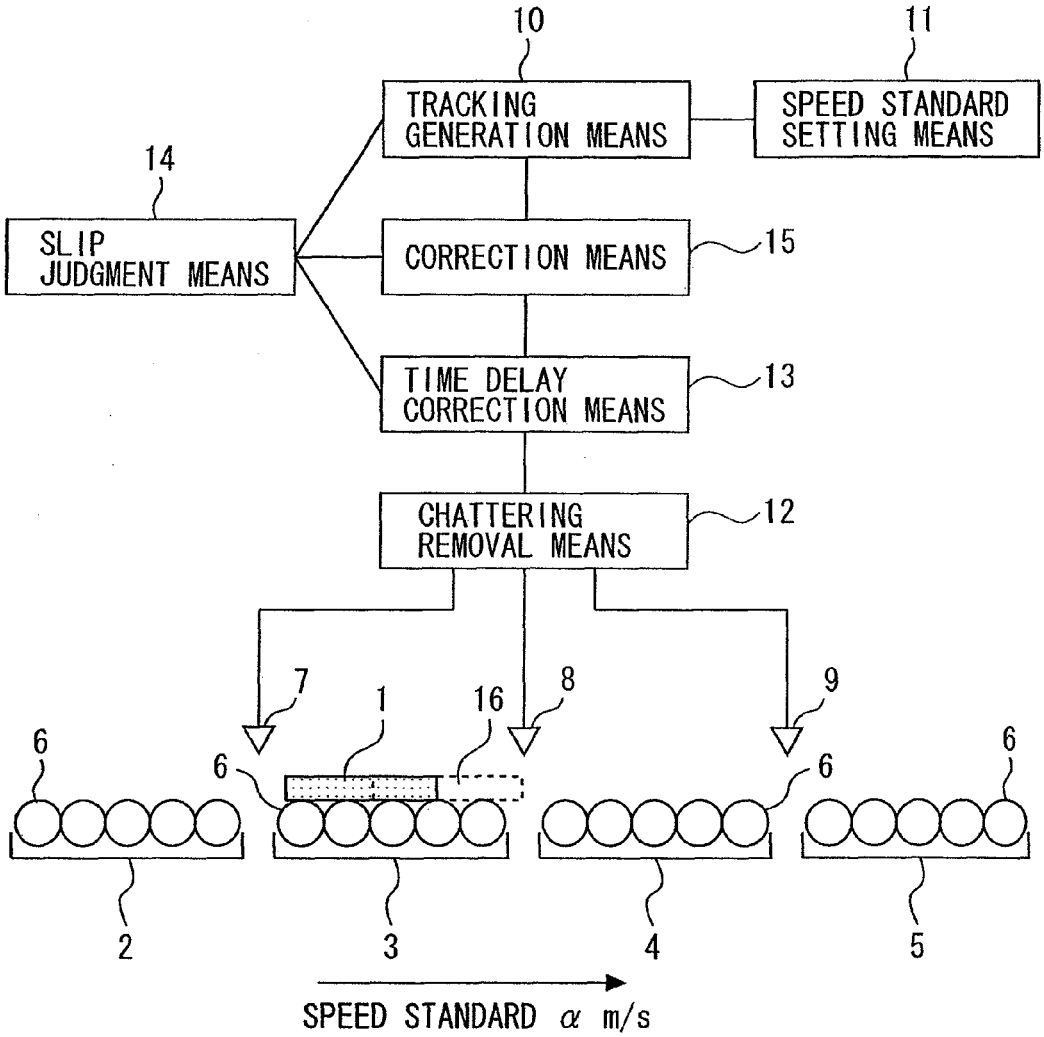
FIG. 1 is a block diagram showing a tracking apparatus in First Embodiment of the present invention.

FIG. 1 is a block diagram showing a tracking apparatus in First Embodiment of the present invention. Reference numeral 1 denotes a conveyed material, which corresponds to a steel sheet and the like in a rolling line, for example. The conveyed material 1 is conveyed by a plurality of conveyance tables 2 to 5 from a prescribed place to a target place (destination of conveyance). The conveyance tables 2 to 5 convey the conveyed material 1 placed on rollers 6 by being driven by a motor or the like, for example. Incidentally, the conveyance tables 2 to 5 are those installed in any zone among the conveyance tables installed up to the destination of conveyance.

In the vicinity of each boundary position of the conveyance tables 2 to 5 arranged adjacent in the conveyance direction of the conveyed material 1, there are provided sensors 7 to 9 which detect the presence or absence of the conveyed material 1. That is, the presence or absence of the conveyed material 1 in a boundary position of the conveyance tables 2 and 3 is detected by the sensor 7, the presence or absence of the conveyed material 1 in a boundary position of the conveyance tables 3 and 4 is detected by the sensor 8, and the presence or absence of the conveyed material 1 in a boundary position of the conveyance tables 4 and 5 is detected by the sensor 9. Incidentally, although FIG. 1 shows a case where the sensors are arranged in all of the boundary positions of the conveyance tables 2 to 5, sensors may also be arranged only in necessary boundary positions.

The tracking apparatus is provided with tracking generation means 10, speed standard setting means 11, chattering removal means 12, time delay correction means 13, slip judgment means 14, and correction means 15.

Tracking 16 of the conveyed material 1 is generated by the tracking generation means 10. For example, the above-described tracking generation means 10 imparts prescribed information, such as identification number (ID) and material, to the conveyed material 1, and causes head end tracking corresponding to a head end position of the conveyed material 1 in the conveyance direction to be generated and tail end tracking corresponding to a tail end position of the conveyed material 1 in the conveyance direction to be generated. Then, the tracking generation means 10 calculates positions of head and tail end tracking by using the conveyance speed (roll rotation number and the like) of a prescribed conveyance table as a speed standard.

The speed standard setting means 11 is means for setting the above-described speed standard used by the tracking generation means 10 during the calculation of positions of head and tail end tracking, and sets changing of the above-described speed standard to a conveyance speed of any one of the conveyance tables on the basis of the positions of head and tail end tracking. For example, the speed standard setting means 11 sequentially changes the above-described speed standard to a conveyance speed of a conveyance table in which the center of tracking 16 is positioned.

Concretely, FIG. 1 shows a case where the length of the conveyed material 1 is smaller than the length of one conveyance table and the whole conveyed material 1 during conveyance is moving on the conveyance table 3 at a conveyance speed $\alpha$[m/s]. In such a case, the tracking generation means 10 totals up amounts of change of a sampling cycle by using the conveyance speed $\alpha$ of the conveyance table 3 as a speed standard and determines positions of head and tail end tracking.

The chattering removal means 12 is composed of a circuit and the like for removing chattering from detection signals of the sensors 7 to 9. The time delay correction means 13 is composed of a circuit and the like for correcting a time delay of head and tail end tracking occurring due to an operation of the above-described chattering removal means 12. Incidentally, concrete operations of the chattering removal means 12 and the time delay correction means 13 will be described later.

The slip judgment means 14 judges occurrence or nonoccurrence of a slip of the conveyed material 1 on the basis of detection signals of the sensors 7 to 9 and positions of head and tail end tracking. In a case where the existence of a slip of the conveyed material 1 has been judged by the above-described slip judgment means 14, a position shift due to the slip between the conveyed material 1 and the tracking 16 is corrected by the above-described correction means 15. Concretely, the correction means 15 first causes head and tail end tracking to stop by using a detection position of a prescribed sensor as a standard and then causes head and tail end tracking to restart so as to eliminate a position shift due to the above-described slip in response to a detection signal of the above-described prescribed sensor after the stop of head and tail end tracking.

Next, a description will be given of an operation of the tracking apparatus to be performed when the above-described position shift has occurred due to a slip. Incidentally, in the following, for the sake of convenience, a case where the conveyed material 1 is conveyed from the conveyance table 2 in the direction of the conveyance table 5 (the right side of the figure) is called a forward movement and a case where the conveyed material 1 is conveyed from the conveyance table 5 in the direction of the conveyance table 2 (the left side of the figure) is called a backward movement.

FIG. 1 shows a condition in which due to the occurrence of a slip, the tracking 16 has shifted in a forward direction from the actual conveyed material 1. When the above-described shift has occurred due to a slip, the correction means 15 first causes the tracking 16 to stop by using, as a standard, a detection position of a sensor which head end tracking next reaches, i.e., a detection position of the sensor 8. Concretely, in a case where upon arrival of head end tracking at a detection position of the sensor 8, the conveyed material 1 has not been detected by the sensor 8, the existence of a slip of the conveyed material 1 is judged by the slip judgment means 14. Then, when the existence of a slip has been judged by the slip judgment means 14, the correction means 15 causes the tracking 16 to stop, with head end tracking aligned with a prescribed position in the vicinity of a detection position of the sensor 8. When the conveyed material 1 has been detected by the sensor 8 after the stop of the tracking 16, the correction means 15 outputs an operation signal to the tracking generation means 10 so that the forward movement of the tracking 16 is caused to restart to adapt to the timing of the detection.

Therefore, even when the conveyed material 1 decelerates or stops a very short time due to a slip occurring during conveyance, it becomes possible to correct the position of tracking 16 in each detection position of the sensors 7 to 9, i.e., in each boundary position of the conveyance tables 2 to 5 and hence it becomes possible to improve tracking accuracy.

Figure 2:
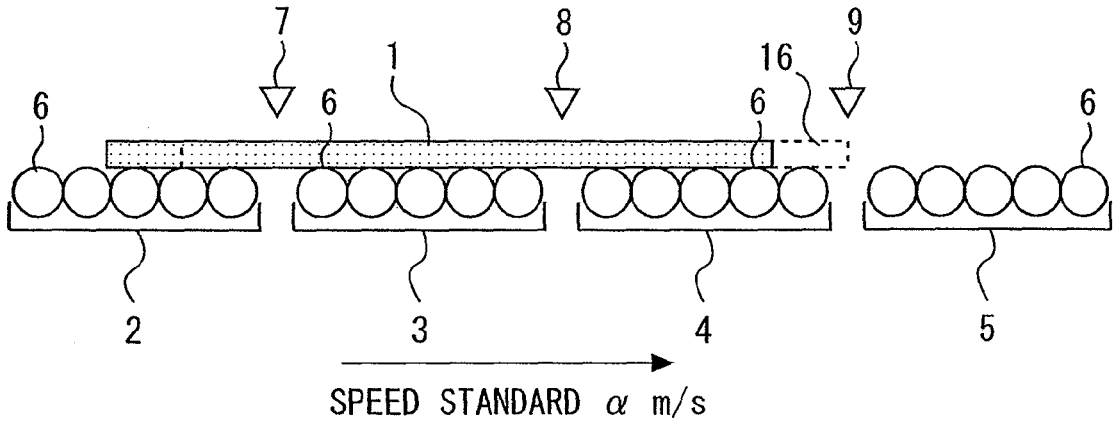
FIG. 2 is a diagram to explain another example of operation of the tracking apparatus in First Embodiment of the present invention.

FIG. 2 is a diagram to explain another example of operation of the tracking apparatus in First Embodiment of the present invention, and shows a case where the length of the conveyed material 1 is larger than the conveyance table length, and the head end of the conveyed material 1 during conveyance is arranged on the conveyance table 4, the middle part on the conveyance table 3 and the tail end on the conveyance table 2. In the case shown in FIG. 2, the center position of the conveyed material 1 in the conveyance direction is arranged on the conveyance table 3. Therefore, the tracking generation means 10 totals up amounts of change of a sampling cycle by using the conveyance speed $\alpha$ of the conveyance table 3 as a speed standard and calculates positions of head end tracking and tail end tracking.

Like FIG. 1, FIG. 2 also shows a condition in which a shift has occurred due to a slip. In such a case, the correction means 15 first causes the tracking 16 to stop by using, as a standard, a detection position of a sensor which head end tracking next reaches, i.e., a detection position of the sensor 9. When the conveyed material 1 has been detected by the sensor 9 after the stop of the tracking 16, the correction means 15 outputs an operation signal to the tracking generation means 10 so that the forward movement of the tracking 16 is caused to restart to adapt to the timing of the detection.

The above-described operation makes it possible to correct the position of the tracking 16 in each boundary position of the conveyance tables 2 to 5 and hence it becomes possible to take steps even when the conveyed material 1 is conveyed, while constantly bridging across a plurality of conveyance tables.

Figure 3:
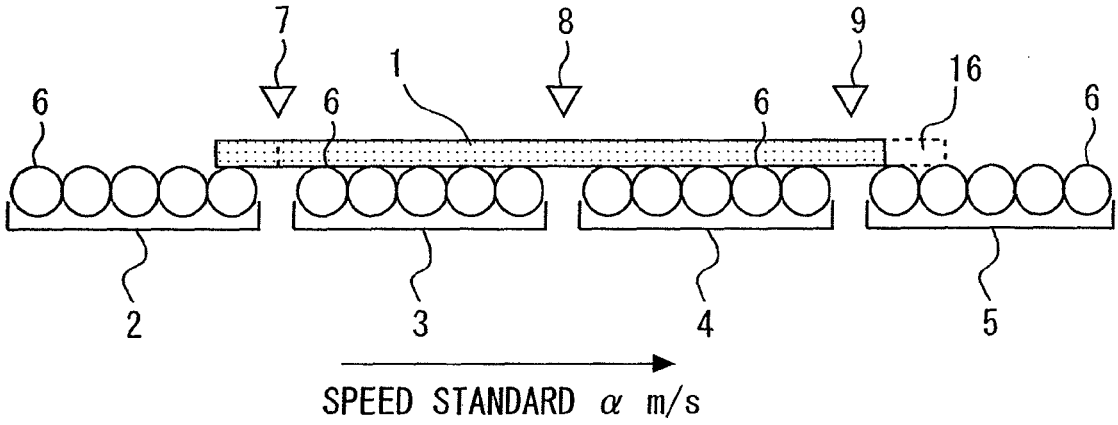
FIG. 3 is a diagram to explain an additional example of operation of the tracking apparatus in First Embodiment of the present invention.

FIG. 3 is a diagram to explain an additional example of operation of the tracking apparatus in First Embodiment of the present invention. The tracking correction on the tail end side of the conveyed material 1 shown in FIG. 2 will be described on the basis of FIG. 3. Incidentally, FIG. 3 shows a case where the tail end of the conveyed material 1 during conveyance is arranged on the conveyance table 2.

When the shift shown in FIG. 3 has occurred due to a slip, the correction means 15 first causes the tracking 16 to stop by using, as a standard, a detection position of a sensor which tail end tracking next reaches, i.e., a detection position of the sensor 7. Concretely, in a case where upon arrival of tail end tracking at a detection position of the sensor 7, the conveyed material 1 is still being detected by the sensor 7, the existence of a slip of the conveyed material 1 is judged by the slip judgment means 14. Then, when the existence of a slip has been judged by the slip judgment means 14, the correction means 15 causes the tracking 16 to stop, with tail end tracking aligned with a prescribed position in the vicinity of a detection position of the sensor 7. When the conveyed material 1 has come to be not detected any more by the sensor 7 after the stop of the tracking 16, the correction means 15 outputs an operation signal to the tracking generation means 10 so that the forward movement of the tracking 16 is caused to restart to adapt to the timing of the non-detection.

In this manner, the tracking correction on the tail end side is simultaneously performed in addition to the tracking correction on the head end side, whereby it becomes possible to ensure further good-accuracy coincidence between the conveyed material 1 and a tracking position thereof.

Figure 4:
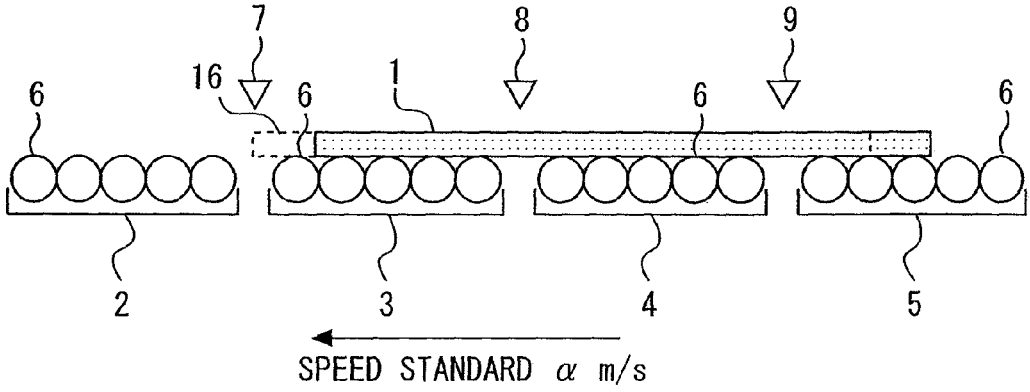
FIG. 4 is a diagram to explain a further example of operation of the tracking apparatus in First Embodiment of the present invention.

FIG. 4 is a diagram to explain a further example of operation of the tracking apparatus in First Embodiment of the present invention. The tracking correction on the head end side to be performed when the conveyed material 1 moves backward will be described on the basis of FIG. 4. Incidentally, FIG. 4 shows a case where the length of the conveyed material 1 is larger than the length of one conveyance table and the head end of the conveyed material 1 during conveyance is arranged on the conveyance table 3.

When the tracking 16 has shifted in the backward direction from the actual conveyed material 1, the correction means 15 first causes the tracking 16 to stop by using, as a standard, a detection position of a sensor which head end tracking next reaches, i.e., a detection position of the sensor 7. Concretely, in a case where upon arrival of head end tracking at a detection position of the sensor 7, the conveyed material 1 has not been detected by the sensor 7, the existence of a slip of the conveyed material 1 is judged by the slip judgment means 14. Then, when the existence of a slip has been judged by the slip judgment means 14, the correction means 15 causes the tracking 16 to stop, with head end tracking aligned with a prescribed position in the vicinity of a detection position of the sensor 7. When the conveyed material 1 has been detected by the sensor 7 after the stop of the tracking 16, the correction means 15 outputs an operation signal to the tracking generation means 10 so that the backward movement of the tracking 16 is caused to restart to adapt to the timing of the detection.

The above-described operation makes it possible to correct the position of the tracking 16 in each boundary position of the conveyance tables 2 to 5 and hence it becomes possible to take steps even when the conveyed material 1 moves backward.

Figure 5:
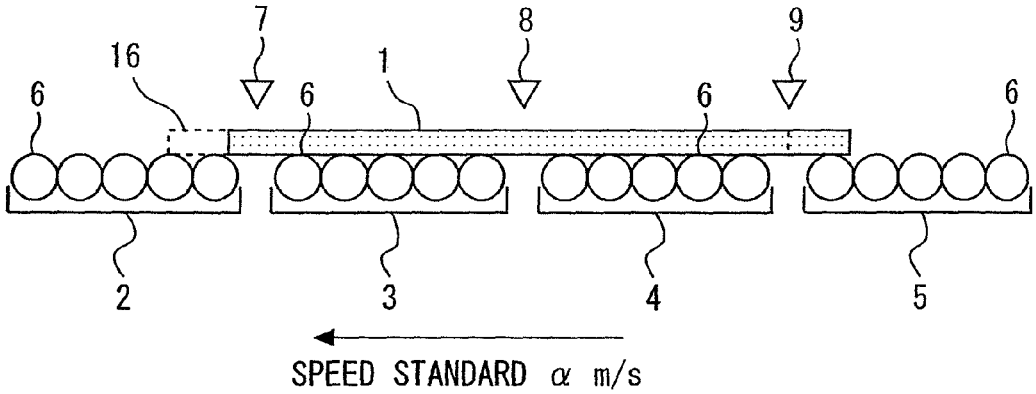
FIG. 5 is a diagram to explain an even further example of operation of the tracking apparatus in First Embodiment of the present invention.

FIG. 5 is a diagram to explain an even further example of operation of the tracking apparatus in First Embodiment of the present invention. The tracking correction on the tail end side of the conveyed material 1 shown in FIG. 4 will be described on the basis of FIG. 5. Incidentally, FIG. 5 shows a case where the tail end of the conveyed material 1 during conveyance is arranged on the conveyance table 5.

When the shift shown in FIG. 5 has occurred due to a slip, the correction means 15 first causes the tracking 16 to stop by using, as a standard, a detection position of a sensor which tail end tracking next reaches, i.e., a detection position of the sensor 9. Concretely, in a case where upon arrival of tail end tracking at a detection position of the sensor 9, the conveyed material 1 is still being detected by the sensor 9, the existence of a slip of the conveyed material 1 is judged by the slip judgment means 14. Then, when the existence of a slip has been judged by the slip judgment means 14, the correction means 15 causes the tracking 16 to stop, with tail end tracking aligned with a prescribed position in the vicinity of a detection position of the sensor 9. When the conveyed material 1 has come to be not detected any more by the sensor 9 after the stop of the tracking 16, the correction means 15 outputs an operation signal to the tracking generation means 10 so that the backward movement of the tracking 16 is caused to restart to adapt to the timing of the non-detection.

In this manner, the tracking correction on the tail end side is simultaneously performed in addition to the tracking correction on the head end side, whereby it becomes possible to increase tracking accuracy also in the case of backward movement.

The foregoing is the method of correcting the head and tail end tracking to be performed when the conveyed material 1 moves forward and moves backward. By adopting this correction method, it becomes possible to take steps even when an irregular conveyance pattern is adopted due to the intervention of manual operations and the like and even when the repetition of forward movement and backward movement is performed.

Figure 6:
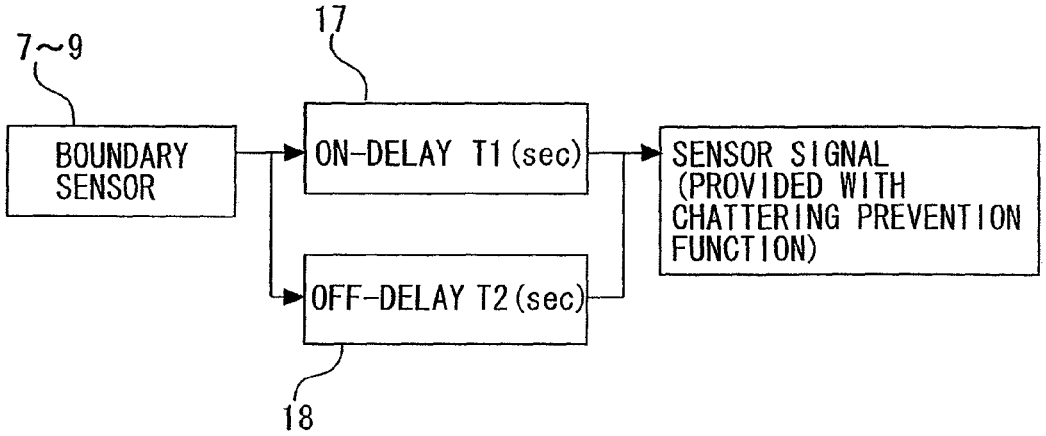
FIG. 6 is a diagram to explain concrete operation of the tracking apparatus in First Embodiment of the present invention.
Figure 7:
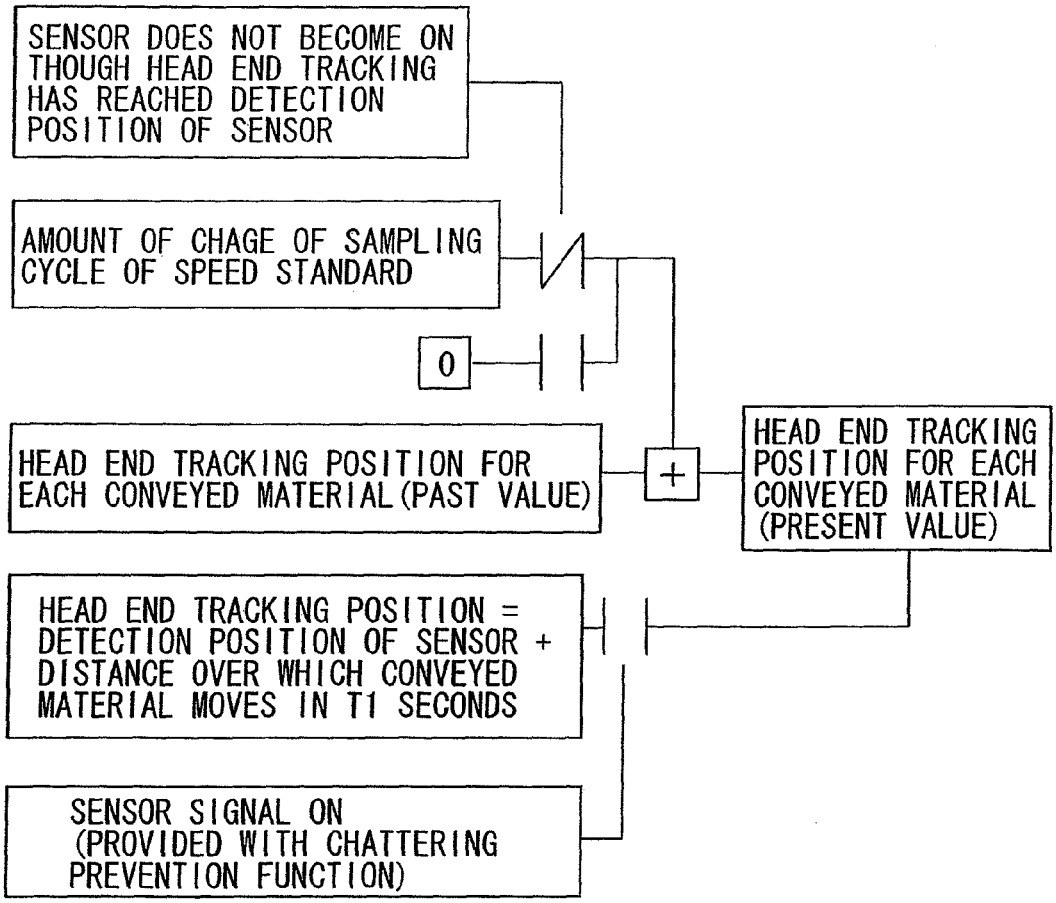
FIG. 7 is a diagram to explain concrete operation of the tracking apparatus in First Embodiment of the present invention.

Next, on the basis of FIGS. 6 and 7, a description will be given of concrete operations including those of the chattering removal means 12, the time delay correction means 13 and the like. Incidentally, FIGS. 6 and 7 are diagrams to explain concrete operations of the tracking apparatus in First Embodiment of the present invention, and FIG. 6 shows the function of the chattering removal means 12. When the tracking apparatus is used in a rolling line and the like, the sensors 7 to 9 are installed in a very severe environment, such as the generation of heat and steam, and the use of oil. For this reason, chattering is included in signals directly inputted from the sensors 7 to 9.

For the above-described chattering, the problem can be solved, for example, by adding an on-delay timer 17 and an off-delay timer 18. Then, the chattering removal means 12 outputs a signal which passes through the on-delay timer 17 (or off-delay timer 18) as a sensor signal. However, because of the addition of the on-delay timer 17 and the off-delay timer 18, a prescribed time delay, which is later than the time at which the conveyed material 1 actually reaches detection positions of the sensors 7 to 9, occurs in the above-described sensor signal.

Next, on the basis of FIG. 7, the function of tracking apparatus including the time delay correction means 13 will be described. Incidentally, in FIG. 7, a case where head end tracking of the conveyed material 1 which moves forward is performed is taken as an example.

In the tracking apparatus, first, the tracking generation means 10 imparts prescribed information, such as ID and material, to the conveyed material 1 and causes head end tracking to be generated in a head end position of the conveyed material 1. The speed standard setting means 11 sets a speed standard used by the tracking generation means 10 during the calculation of positions of head and tail end tracking. Incidentally, for example, by finding a conveyance table X meeting the following condition, the speed standard setting means 11 makes a judgment as to on which conveyance table the center position of the tracking 16 is present.

Downstream end position of conveyance table X<head end tracking position−(length of conveyed material/2)<upstream end position of conveyance table X Then, the tracking generation means 10 calculates the current position of the head end tracking by totaling up amounts of change of a sampling cycle of a speed standard obtained on the basis of the above-described conditional expression. That is, amounts of change of a sampling cycle of a speed standard are added to the most recently obtained position of head end tracking (a past value), whereby the current position of the head end tracking (a present value) is obtained.

When no slip has occurred in the conveyed material 1, the tracking apparatus performs the calibration of head end tracking in a detection position of each of the sensors 7 to 9. That is, at the timing of switching of one of the sensors 7 to 9 from off to on, the position of head end tracking is corrected by using a detection position of the sensor as a standard. However, because the chattering removal function is added to a sensor signal as described above, a value in which a time delay due to chattering removal is considered (for example, a value obtained by adding a distance over which the conveyed material 1 moves in T1 seconds to the detection position of a sensor which has been switched to on) is used as a calibration value.

On the other hand, in a case where upon arrival of head end tracking at a detection position of a prescribed sensor, the conveyed material 1 has not been detected by the prescribed sensor, until the conveyed material 1 becomes detected by the sensor, amounts of change of a sampling cycle of a speed standard are taken as 0 and these amounts of change are added to the most recently obtained position of head end tracking (a past value). That is, head end tracking is caused to stop.

The following are examples of calculation of head end tracking $\beta_h(m)$ and tail end tracking $\beta_t(m)$ by the tracking generation means 10.

$$\beta_h=\Sigma\{\alpha(X)\times\text{PLC cycle (ms)}/1000\}+\text{start position of head end tracking}$$

$$\beta_t=\Sigma\{\alpha(X)\times\text{PLC cycle (ms)}/1000\}+\text{start position of tail end tracking}$$

where $\alpha$ (X) is the speed (m/s) of a table in which the center of the conveyed material 1 is positioned.

The following show examples of operation of the correction means 15 performed when the occurrence of a slip has been judged by the slip judgment means 14:

1) Head end tracking correction performed when the conveyed material 1 moves forward When the relationship $\beta_h \geqq$ prescribed sensor position holds and the above-described prescribed sensor is off, by making PLC cycle (ms)=0, head and tail end tracking is caused to stop.

2) Tail end tracking correction performed when the conveyed material 1 moves forward When the relationship $\beta_t \geqq$ prescribed sensor position holds and the above-described prescribed sensor is on, by making PLC cycle (ms)=0, head and tail end tracking is caused to stop.

3) Head end tracking correction performed when the conveyed material 1 moves backward When the relationship $\beta_h \leqq$ prescribed sensor position holds and the above-described prescribed sensor is off, by making PLC cycle (ms)=0, head and tail end tracking is caused to stop.

4) Tail end tracking correction performed when the conveyed material 1 moves backward When the relationship $\beta_t \leqq$ prescribed sensor position holds and the above-described prescribed sensor is on, by making PLC cycle (ms)=0, head and tail end tracking is caused to stop.

According to First Embodiment of the present invention, it becomes possible to ensure good-accuracy coincidence between the conveyed material 1 and a tracking position thereof even when a slip occurs in the conveyed material 1 moving across a plurality of conveyance tables. Also, it becomes possible to positively synchronize head end tracking and tail end tracking by using the speed standard setting means 11.

INDUSTRIAL APPLICABILITY

As described above, according to the tracking apparatus of the present invention, it is possible to ensure good-accuracy coincidence between the conveyed material moving cross a plurality of conveyance tables and a tracking position thereof and it is possible to take steps easily when the conveyance distance is long and when the environment is very severe.

The invention claimed is:

1. A tracking apparatus for tracking position of a material being transported, the apparatus comprising:

a plurality spaced apart conveyance tables located along a line and including driven parts which convey a conveyed material toward a target position, the conveyed material having a head end;

a plurality of sensors detecting the head end of the conveyed material, each sensor being located at a respective detection position between a respective pair of the conveyance tables, the sensors detecting actual head end position of the conveyed material as the conveyed material is conveyed by the conveyance tables;

a tracking generator which calculates a calculated head end tracking position of the head end of the conveyed material using a conveyance speed of a respective conveyance table as a reference speed;

reference speed setting means which changes the reference speed of the respective conveyance table based on the calculated head end tracking position of the conveyed material;

a delay timer delaying, by a time delay, generation of detection signals of the sensors apparently detecting the head end of the material conveyed;

time delay correcting means which corrects the time delay of the detection signals of the sensors which has been inserted by the delay timer;

slippage detection means detecting slippage of the conveyed material based on detection by a respective sensor of the head end of the conveyed material, as the conveyed material reaches the detection position of the respective sensor, and the calculated head end tracking position, calculated by the tracking generator; and correcting means which stops calculation of the calculated head end tracking position, upon detection of slippage by the slippage detection means, and resets calculation of the calculated head end tracking position by the tracking generator, based on correction of the time delay by the time delay correcting means, upon detection of the head end of the conveyed material by the respective sensor.

* * * * *